US006320936B1

(12) United States Patent
Holland, Sr. et al.

(10) Patent No.: US 6,320,936 B1
(45) Date of Patent: Nov. 20, 2001

(54) X-RAY TUBE ASSEMBLY WITH BEAM LIMITING DEVICE FOR REDUCING OFF-FOCUS RADIATION

(75) Inventors: William P. Holland, Sr., New Milford; Timothy J. Holland, Southbury; Matthew J. Holland; Michael L. Holland, both of New Milford, all of CT (US)

(73) Assignee: Parker Medical, Inc., Bridgewater, CT (US)

( * ) Notice: Subject to any disclaimer, the term of this patent is extended or adjusted under 35 U.S.C. 154(b) by 0 days.

(21) Appl. No.: 09/449,778

(22) Filed: Nov. 26, 1999

(51) Int. Cl.[7] ..... G21K 1/02
(52) U.S. Cl. ..... 378/140; 378/147; 378/150
(58) Field of Search ..... 378/140, 147, 378/150

(56) References Cited

U.S. PATENT DOCUMENTS

| | | | | |
|---|---|---|---|---|
| 3,683,191 | | 8/1972 | Machachlan et al. | 378/114 |
| 3,947,689 | | 3/1976 | Wagner | 378/151 |
| 3,947,690 | | 3/1976 | Peyser | 378/153 |
| 4,086,494 | | 4/1978 | Malak | 378/153 |
| 4,145,616 | * | 3/1979 | Tanabe | 378/150 |
| 4,246,488 | | 1/1981 | Hura | 378/151 |
| 4,250,387 | | 2/1981 | Hounsfield et al. | 378/18 |
| 4,283,447 | | 8/1981 | Flynn | 428/36 |
| 4,309,637 | | 1/1982 | Fetter | 378/130 |
| 4,336,476 | | 6/1982 | Holland et al. | 378/125 |
| 4,472,827 | * | 9/1984 | Gabbay et al. | 378/140 |
| 4,573,185 | | 2/1986 | Lounsberry et al. | 378/125 |
| 4,672,648 | | 6/1987 | Mattson et al. | 378/4 |
| 4,712,226 | | 12/1987 | Horbaschek | 378/134 |
| 4,730,353 | | 3/1988 | Ono et al. | 378/138 |
| 4,905,268 | | 2/1990 | Mattson et al. | 378/158 |
| 5,003,452 | | 3/1991 | Sireul et al. | 363/61 |
| 5,033,074 | * | 7/1991 | Cotter et al. | 378/147 |
| 5,237,599 | | 8/1993 | Gunji et al. | 378/148 |
| 5,256,334 | | 10/1993 | Smid et al. | 252/478 |
| 5,303,459 | | 4/1994 | Kurakake | 29/407 |
| 5,493,599 | | 2/1996 | Mattson | 378/147 |
| 5,539,798 | | 7/1996 | Asahina et al. | 378/98.5 |
| 5,822,395 | | 10/1998 | Schardt et al. | 378/137 |
| 6,185,279 | * | 2/2001 | Chambron | 378/161 |

OTHER PUBLICATIONS

Randmer, Koller and Holland,"X–ray Sources And Controls", *Computed Tomography Instrumentation*, vol. 5, CV Mosby Co., p. 4086, dated more than one year prior to the filing date of this patent application.

* cited by examiner

*Primary Examiner*—Robert H. Kim
*Assistant Examiner*—Allen C. Ho
(74) *Attorney, Agent, or Firm*—Cummings & Lockwood

(57) ABSTRACT

A beam limiting apparatus is provided for reducing the amount of off-focus radiation in the image-forming beam emitted from an x-ray tube assembly. The x-ray tube assembly has a housing with an x-ray port for the passage of x-rays therethrough, a mounting boss defining the x-ray port, an x-ray tube mounted within the housing and defining a glass envelope, an anode mounted within the glass envelope, and a cathode spaced relative to the anode within the glass envelope. A peripheral flange of the beam limiting apparatus is mountable to the mounting boss of the x-ray tube housing, and a radiation-absorbing body of the beam limiting apparatus projects downwardly from the peripheral flange through the x-ray port. The radiation-absorbing body is formed of an electrically nonconductive, filled epoxy resin material, and defines a base surface, an x-ray entrance aperture formed through the base surface, an x-ray exit aperture spaced relative to the x-ray entrance aperture, and an x-ray transmissive beam conduit formed between the entrance and exit apertures. An x-ray transmissive window is integrally molded with the radiation-absorbing body and extends across the beam conduit. The base surface of the radiation-absorbing body is spaced closely adjacent to the glass envelope of the x-ray tube and defines a predetermined gap therebetween. The x-ray tube housing also is molded of an electrically non-conductive, radiopaque, filled epoxy resin material, and includes a conductive outer surface formed of a conductive coating.

20 Claims, 4 Drawing Sheets

X-RAY TUBE ASSEMBLY WITH BEAM LIMITING DEVICE FOR REDUCING OFF-FOCUS RADIATION

FIELD OF THE INVENTION

The present invention relates to x-ray tube assemblies, and more particularly, to x-ray tube assemblies including beam limiting devices for reducing off-focus radiation and for collimating or pre-collimating x-ray beams, and further relates to x-ray tube housings formed of moldable, radiation absorbing materials, such as filled epoxy resins, and other thermoset and thermoplastic polymers.

BACKGROUND OF THE INVENTION

A typical x-ray tube comprises an evacuated glass tube with an anode and cathode spaced relative to each other within the tube. The anode and cathode are maintained at a high differential voltage relative to each other, typically on the order of about 150 kV or less for medical applications. The anode may be maintained at ground, and the cathode may be maintained at a relatively high negative potential, e.g., −150 kV. Alternatively, the anode may be maintained at a positive potential, e.g., +75 kV, and the cathode may be maintained at a negative potential, e.g., −75 kV. The cathode thermionically emits electrons which are electrostatically directed onto a target surface of the anode with sufficient energy to generate x-rays which emerge from the target in a diffuse pattern. A considerable amount of heat is generated at the anode during operation of an x-ray tube. Thus, in x-ray tubes having stationary anodes, a cooling fluid, such as oil, typically flows through a base portion of the anode to cool the anode to permit a higher x-ray output and prevent overheating and deformation of the target surface. In rotating anode x-ray tubes, on the other hand, the target surface is typically defined by a rotating disc so that the region of electron incidence is distributed over an annular target surface area. Thus, in rotating anode x-ray tubes, the energy of the incident electrons is typically distributed over a larger surface area than in stationary anode tubes, thereby allowing for higher peak energies operating for short times.

The cathode comprises one or more filaments for generating the electron beam, and the filaments project a focal spot area onto the target surface of the anode. Typically, the focal spot area is rectangular; however, the cathode filaments may take any of various different shapes, and thus the focal spots likewise may correspondingly vary in shape. The x-ray tube is mounted within a hermetically-sealed housing, and the housing defines an x-ray port radially aligned with the focal spot on the target surface. The housing is filled with oil to electrically insulate the tube, and frequently, a heat exchanger is either mounted to the housing, or remotely connected to the housing to cool the oil and thereby cool the x-ray tube. The housing is typically formed of aluminum, and the interior surfaces of the housing are lined with a radiation absorbing material, typically lead. An x-ray window made of an x-ray transmissive material is mounted over the x-ray port to allow the diffuse radiation beam to pass out of the housing through the x-ray window only. Frequently, the transmissive window is made of a transparent, polymeric material, such as polycarbonate, and defines a frusto-conical or cup-like shape. The cup-like window projects into the housing, such that the base of the window is spaced closely adjacent to the exterior surface of the glass x-ray tube. Alternatively, the x-ray windows have been made of non-transparent, metallic materials, such as aluminum and beryllium, which are also radiation transmissive. However, the polymeric windows may be made transparent, and thereby allow an operator to view the interior of the housing. In addition, the polymeric windows are non-conductive, and therefore may be mounted in close proximity to the glass x-ray tube. The metallic windows, on the other hand, must be spaced a sufficient distance from the glass x-ray tube to avoid high voltage arcing between the metallic window and tube. The oil within the housing may include gas bubbles, particulate matter, or other non-homogeneous materials, and if any such bubbles or particulates pass between the tube and x-ray window during operation, they may show up as artifacts on the x-ray image. Accordingly, one advantage of the polymeric x-ray windows is that they may be mounted in close proximity to the tube in order reduce the thickness of oil between the tube and window and thereby minimize the possibility of any gas bubbles negatively effecting the x-ray images. One of the drawbacks of the polymeric windows, however, is that the high energy x-rays tend to destroy the molecular bonds of the polymeric material, and if such windows are not replaced, they can eventually craze and/or crack. This condition not only may negatively affect the x-ray images, but may destroy the hermetic seal of the housing and, in some cases, allow oil to leak from the housing.

It is well understood in the prior art, and particularly in connection with computerized tomography ("CT"), that the x-rays emanating from the focal spot should be precisely collimated into a fan or other preselected shaped beam, in order to cover the image detector surface. One phenomena that can have a significantly negative effect on the image quality of x-ray images is "off-focus" radiation (also referred to as "off-focal" radiation). Off-focus radiation is primarily produced by energetic back-scattered electrons that produce x-radiation outside of the focal spot. These secondary electrons tend to cause x-rays to be generated from broad areas of the anode and possibly surrounding material that may be at a positive potential relative to the cathode. In addition, high field emission electrons from portions of the cathode other than the filament may impinge on the target and possibly other surrounding material outside of the focal spot and, in turn, create additional off-focus radiation. Both standard radiographic and CT apparatus typically require a well-defined x-ray source. Accordingly, off-focus radiation reduces the image resolution of both conventional x-ray and CT imaging apparatus, and increases the radiation exposure level to patients and technicians.

In order to reduce off-focus radiation, and control the size and shape of the x-ray beam, conventional x-ray tube assemblies have incorporated a beam limiting device in the form of a lead plate mounted on the outer side of the x-ray window. The lead plate has formed therein a beam-defining aperture corresponding in size and shape to the desired beam. Thus, the lead plate operates as a first stage of control to define the size and shape of the beam and block any off-focus radiation outside the periphery of the aperture. One drawback associated with these types of prior art beam limiting devices, is that the lead is conductive, and therefore the beam limiting device cannot be located in close proximity to the high voltage x-ray tube. As a result, substantial off-focus radiation may be allowed to pass through the aperture and, in turn, degrade the resolution of the x-ray image.

Other prior art x-ray tube assemblies have included beam limiting devices mounted directly onto the glass x-ray tubes. For example, one such prior art beam limiting device is an elongated, arcuate-shaped device having a rectangular beam slot formed therethrough. The device is made of a radiation absorbing, non-conductive, thermoset material sold under the trademark LITHARGE™. This beam limiting device is mounted directly onto the glass x-ray tube between the focal spot and the x-ray window, and is attached to the tube with a silicone ("RTV") adhesive. Thus, the rectangular slot is designed to control the size and shape of the x-ray beam, and the surrounding LITHARGE™ material is designed to filter out any off-focus radiation impinging thereon. One of the drawbacks associated with these types of prior art beam limiting devices is that they must be adhesively or mechanically attached to the glass tubes. The silicone adhesives, such as the RTV adhesives, tend to degrade over time, particularly as a result of radiation exposure. Accordingly, these types of beam limiting devices can become detached from the x-ray tubes and/or the silicone or other adhesives can break off or dissolve into the oil, which, in turn, negatively affects the dielectric and/or other properties of the oil. Another drawback of these types of beam limiting devices is that the thermoset materials require relatively expensive tooling, and do not lend themselves to allowing easy and inexpensive manufacture of complex parts.

Another drawback of the above-described prior art x-ray tube assemblies is that the use of lead to line the interior of the housings involves relatively time-consuming, labor-intensive, and expensive manufacturing procedures. Typically, the lead lining consists of a plurality of lead pre-forms, each of which must be cut and shaped with special dies and tooling to conform to a respective portion of the housing. Then, the pre-forms must be pressed into the housing, and fixedly secured to the housing. The lead is hazardous to handle, and therefore requires either expensive automated assembly equipment, and/or sophisticated procedures and handling equipment to prevent assembly workers from improper exposure to the lead. In addition, the lead presents significant problems and costs in connection with its disposal.

Accordingly, it is an object of the present invention to overcome one or more of the above-described drawbacks and disadvantages of prior art x-ray tube assemblies.

SUMMARY OF THE INVENTION

The present invention is directed to a beam limiting apparatus for reducing the emission of off-focus radiation from an x-ray tube assembly and for containing the x-rays generated other than from the focal spot. The x-ray tube assembly comprises a housing including an x-ray port allowing the throughput of x-rays, and a mounting surface formed adjacent to the x-ray port. An x-ray tube is mounted within the housing and includes an evacuated envelope, an anode mounted within the envelope, and a cathode spaced relative to the anode within the envelope. The anode defines a target surface, the cathode projects onto the target surface a focal spot defining a focal spot size and shape, the x-ray port is spaced relative to the focal spot for receiving x-radiation emitted therefrom, and the x-ray port and envelope define a first predetermined depth therebetween. The beam limiting apparatus comprises a peripheral flange defining a second mounting surface locatable over the first mounting surface of the housing for fixedly securing the beam limiting apparatus to the housing. A radiation-absorbing body of the beam limiting apparatus projects downwardly from the peripheral flange and is receivable through the x-ray port. The radiation-absorbing body defines a base surface, an x-ray entrance aperture formed through the base surface, an x-ray exit aperture formed through an approximately opposite side of the body relative to the x-ray entrance aperture, and an x-ray transmissive beam conduit formed between the entrance and exit apertures. The base surface of the radiation-absorbing body extends into the housing a second depth less than the first depth, with the base surface spaced closely adjacent to the evacuated envelope of the x-ray tube to define a predetermined gap therebetween. The radiation-absorbing body is formed of a substantially electrically nonconductive, filled polymeric radiopaque material to prevent the passage of x-radiation therethrough. In addition, the x-ray entrance aperture defines a second size and shape, the x-ray exit aperture defines a third size and shape, and the second and third sizes and shapes are selected to define an x-ray beam of predetermined corresponding size and shape.

In accordance with a preferred embodiment of the present invention, the x-ray tube housing also is formed of the filled polymeric, electrically non-conductive, radiopaque material. Preferably, the housing is formed of two castings, wherein a first casting defines the beam limiting apparatus integral with the x-ray port, a hermetically-sealed, radiopaque enclosure for receiving the x-ray tube, anode and cathode plug cavities for receiving high-voltage plugs, and an oil pump cavity for pumping oil through the hermetically-sealed enclosure to electrically insulate and cool the x-ray tube. The second casting preferably defines a cover which is attachable to the first casting to enclose the x-ray tube, and forms a hermetic seal with the first casting to seal the x-ray tube and oil within the housing. A conductive layer, preferably in the form of a conductive paint or like coating, is applied to the exterior surface of at least one of the first and second castings.

One advantage of the beam limiting apparatus of the present invention is that it is made of a non-conductive, radiopaque material, and therefore may be mounted in close proximity to the x-ray tube to more effectively reduce the transmission of off-focus radiation.

Another advantage of the beam limiting apparatus of the present invention is that an x-ray transmissive window may be molded into the radiation-absorbing body, and the window may be made of an opaque metal, a transparent polymeric elastomer, or other desired material.

Yet another advantage of the present invention is that the x-ray tube housing may be made of a filled polymeric material, which is electrically non-conductive, and radiopaque, and therefore the drawbacks and disadvantages associated with prior art, lead-lined housings may be entirely avoided.

Other objects and advantages of the present invention will become apparent in view of the following detailed description and accompanying drawings.

DETAILED DESCRIPTION OF THE PREFERRED EMBODIMENT

Figure 1:
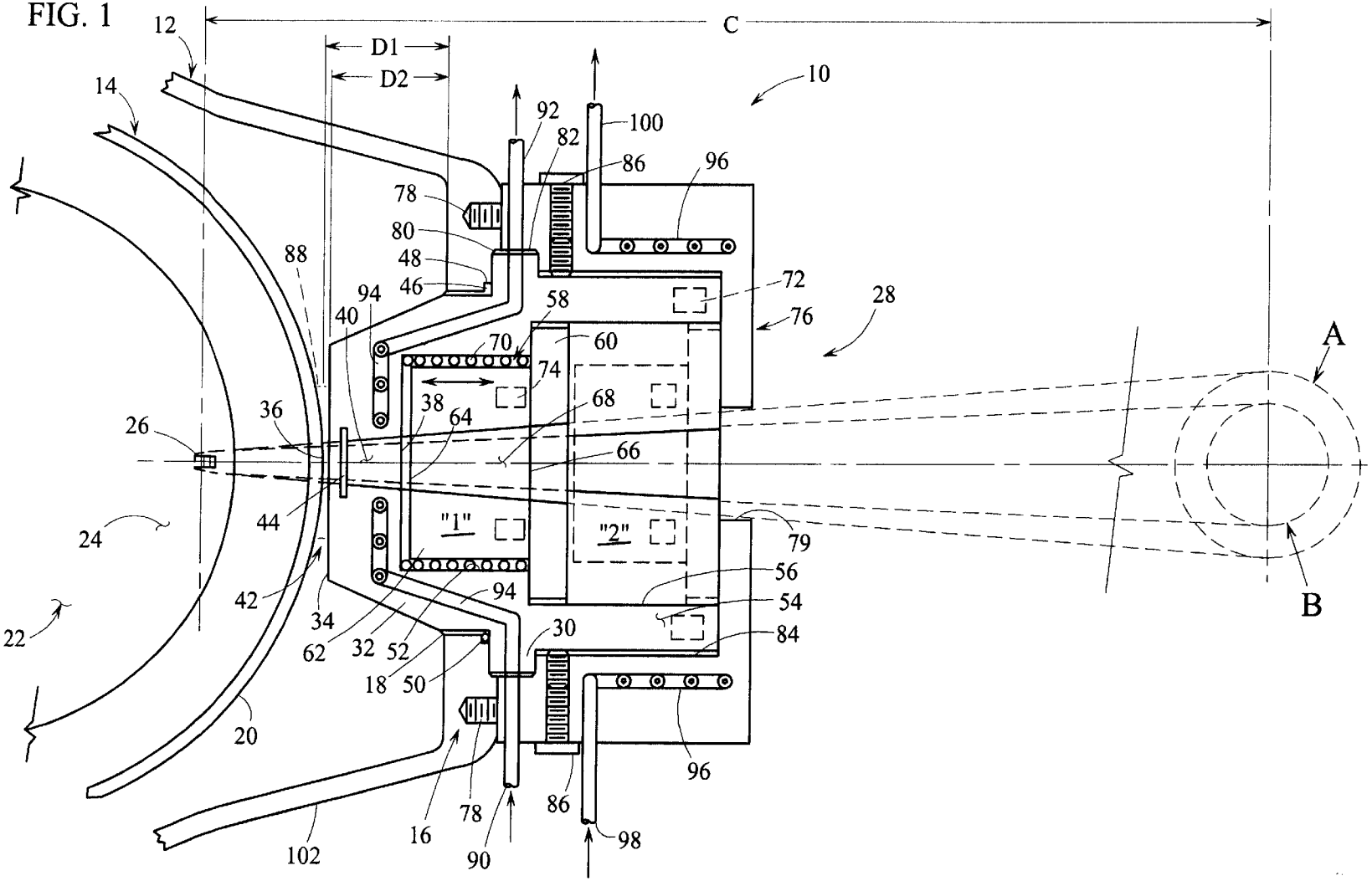
FIG. 1 is a partial schematic, cross-sectional view of a first embodiment of a beam limiting apparatus of the invention mounted within an x-ray tube assembly.

In FIG. 1, an x-ray tube assembly embodying the present invention is indicated generally by the reference numeral 10. The x-ray tube assembly 10 comprises a housing 12 and an x-ray tube 14 mounted within the housing. The x-ray tube housing 12 comprises a mounting boss 16 defining an x-ray port 18 extending through the mounting boss and into the interior of the housing. The x-ray tube 14 includes an evacuated glass envelope 20, a rotating anode 22 defining a target surface 24, and a cathode (not shown) spaced relative to the anode within the glass envelope. As will be recognized by those skilled in the pertinent art based on the teachings herein, the x-ray tube 14 may be any of numerous different types of x-ray tubes which are now or later become known for generating x-radiation, including, for example, any of numerous different types of rotating anode or stationary anode tubes, and/or tubes defining glass envelopes, metal envelopes, or envelopes formed of combinations of metal, glass and ceramic. The anode and cathode are maintained at a high differential voltage relative to each other, typically on the order of about 150 kV or less. As will be recognized by those skilled in the pertinent art based on the teachings herein, however, the differential voltage may be any voltage required by the application(s) of the x-ray tube assembly 10. Similarly, the differential voltage may be created in any of numerous different ways. For example, as described above, the anode 22 may be maintained at ground, and the cathode may be maintained at a relatively high negative potential. Alternatively, the anode 22 may be maintained at a positive potential, e.g., +75 kV, and the cathode may be maintained at a negative potential, e.g., −75 kV. The cathode thermionically emits electrons which are electrostatically directed into a focal spot 26 located on the rotating target surface 24 of the anode 22 with sufficient energy to generate x-rays which emerge from the target in a diffuse pattern. As indicated above, the size and shape of the focal spot 26 may be dictated by the size and shape of the filaments (not shown) of the cathode. Typically, the focal spot area 26 is rectangular; however, the cathode filaments may take any of various different sizes and shapes, and thus the focal spot 26 likewise may correspondingly vary in size and shape. The x-ray housing 12 is hermetically sealed, and is filled with an insulating oil (not shown) to electrically insulate the x-ray tube 14 within the housing.

As also shown in FIG. 1, a beam limiting apparatus 28 of the invention is mounted on the boss 16 and extends through the x-ray port 18 into the interior of the housing 12 adjacent to the focal spot 26. The beam limiting apparatus 28 comprises a peripheral flange 30, and a radiation-absorbing or radiopaque body 32 projecting downwardly from the peripheral flange and received through the x-ray port 18 and into the interior of the housing 12. Unless otherwise indicated, the term "radiopaque" is used synonymously with "radiation absorbing" and "radiation blocking" throughout this specification, and is intended to mean preventing or not allowing the passage of substantially all x-rays through the respective material, component or portion of the apparatus. The radiation-absorbing body 32 defines a base surface 34, an x-ray entrance aperture 36 formed through the base surface, an x-ray exit aperture 38 formed through an approximately opposite side of the base wall relative to the x-ray entrance aperture, and an x-ray transmissive beam conduit 40 extending between the entrance and exit apertures. The x-ray port 18 and evacuated envelope 20 define a first predetermined depth "D1" therebetween, and the base surface 34 of the body 32 extends into the housing a second depth "D2", which is close to, but less than the first depth "D1", such that the base surface 34 is spaced closely adjacent to the evacuated envelope 20 of the x-ray tube and defines a predetermined gap 42 therebetween. The gap 42 is sufficient to allow differential thermal expansion between the x-ray tube and beam limiting apparatus without contacting each other during operation of the x-ray tube. In the illustrated embodiment of the invention, the width of the predetermined gap 42 is approximately 0.060 inch, and is preferably within the range of approximately 0.040 to approximately 0.080 inch. However, as will be recognized by those skilled in the pertinent art based on the teachings herein, the width of the gap 42 may fall outside of this range in particular applications, particularly if necessary to provide sufficient space to allow differential thermal expansion of these closely spaced parts without contacting each other during operation of the x-ray tube. For example, for relatively large x-ray tubes and housings, it may be necessary to increase the width of the gap 42 over that described herein in order to ensure sufficient space to allow for differential thermal expansion during operation of the x-ray tube. Alternatively, if the envelope of the tube is made of metal, or includes a metal portion adjacent to the base surface 34 of the radiation-absorbing body 32, the tube may be sufficiently strong to allow the parts to contact each other, and therefore the gap may be eliminated.

The radiolucent or x-ray transmissive window 44 is mounted between the x-ray entrance aperture 36 and exit aperture 38, and extends across the beam conduit 40. In the illustrated embodiment of the present invention, the x-ray transmissive window 44 is molded integral with the radiation absorbing body 32, and is made of a radiolucent material having a predetermined aluminum equivalent filtration in order to achieve a predetermined overall filtration of the image-forming x-ray beam. Accordingly, the x-ray transmissive window 44 may be made of any of numerous different materials which are currently, or later become known for performing the functions of the window described herein. For example, the window 44 may be made of aluminum, or any other desired x-radiation transmissive metal. Alternatively, the window 44 may be made of a transparent epoxy resin, a polycarbonate, glass or other optically transparent and radiolucent material, in order to allow an operator to view the interior of the housing through the window. In each case, the window 44 is preferably integrally molded with the radiation-absorbing body and defines a hermetic seal between the window and body, as described further below.

The peripheral flange 30 defines a mounting surface 46 on the underside of the flange for mounting the beam limiting apparatus 28 to the mounting boss 16 of the housing 12. As shown in FIG. 1, the mounting boss 16 of the housing defines an o-ring groove or like recess 48 extending about the periphery of the x-ray port 18, and an o-ring or other suitable sealing member 50 is seated within the groove between the mounting surface 46 and mounting boss 16 to hermetically seal the beam limiting apparatus 28 to the housing 12.

The radiation-absorbing body 32 defines a first cylindrical recess on the interior side of the body, and extending downwardly from the peripheral flange 30 to the base wall of the body. A cylindrical wall 54 extends upwardly on the opposite side of the flange 30 relative to the first recess 52, and defines a second cylindrical recess 56 on the interior thereof.

The radiopaque body 32, peripheral flange 30, and cylindrical wall 54 are formed of a substantially electrically nonconductive, filled polymeric material, and as can be seen, are integrally molded in a single casting. In the currently preferred embodiment of the invention, the polymeric material is a filled epoxy resin material sold by Lord Corp., Chemical Products Division, of Atlanta, Ga., under the trademark "Circalok", wherein the resin is part number 6703A, and the hardener is part number 6703B. This filled epoxy resin is also designated "H253 P1" by the Assignee of the present invention in connection with the sales of its products molded from this material. The Circalok filled epoxy resin is an oil-based resin, and is filled with a radiation-absorbing material, such as lead oxide. This material is electrically non-conductive, and radiopaque, and exhibits the following approximate physical characteristics:

| | |
|---|---|
| Specific Gravity (g/cc) | 4.05 |
| Hardness (shore D) | 90 |
| Tensile Strength (psi) | 8,100 |
| Compressive Strength at 25° C. (psi) | 13,200 |
| Linear Shrinkage (in/in) | 0.004 |
| Service Temperature (° C.) | −60 to 155 |
| Thermal conductivity (cal/sec/cm$^2$/° C. × $10^{-4}$) | >7.8 |
| (BTU/ft$^2$/hr/° F./in) | >2.3 |
| Coefficient of thermal expansion (in/in/° C. × $10^{-6}$) | <38 |
| Thermal resistance (° C./in/watt) | 128 |
| Volume resistivity at 25° C. (ohm/cm) | $10^{15}$ |
| Dielectric constant at 25° C. (100 KC) | 4.1 |
| Dissipation Factor at 25° C. (100 KC) | 0.02 |
| Dielectric strength | 400–500 |

As will be recognized by those skilled in the pertinent art based on the teachings herein, the filled polymeric material may take the form of any of numerous other like materials that are currently, or later become known for performing the functions of the filled epoxy resin described herein. One advantage of the filled epoxy resin employed in the apparatus of the present invention, is that it allows the x-ray transmissive window 44 to be easily molded integral with the radiation-absorbing body and other components of the beam limiting apparatus. In addition, the base resin employed may be optically transparent, and therefore may be used to integrally mold the x-ray transmissive window only to be both optically transparent and radiolucent, and thereby allow a user to view the interior of the housing therethrough.

As further shown in FIG. 1, a beam-adjusting mechanism 58 is slidably received within the first and second recesses 52 and 56 for selectively adjusting the size of the x-ray beam. The beam-adjusting mechanism 58 includes a guide flange 60 defining an approximately disc-like shape and slidably received within the second cylindrical recess 56. A second radiation-absorbing body 62 projects downwardly from the guide flange 60, and defines a second x-ray entrance aperture 64 on the bottom side of the body, a second x-ray exit aperture 66 formed on the opposite side of the guide flange 60, and an approximately frusto-conical shaped second beam conduit 68 formed between the entrance and exit apertures. A coil spring 70 is seated between the base wall of the first recess 52 and the underside of the guide flange 60 to normally bias the guide flange, and thus the beam-adjusting mechanism upwardly or away from the focal spot 26. The guide flange 60 and radiation-absorbing body 62 are integrally molded of the same filled polymeric material as the other components of the beam limiting apparatus as described above. However, as will be recognized by those skilled in the pertinent art based on the teachings herein, any of numerous different filled polymeric materials and/or other materials may be employed for performing the functions of these components described herein.

As indicated in phantom in FIG. 1, an electric coil 72 is integrally molded within the upper end of the cylindrical wall 54 and extends along the upper periphery of the second cylindrical recess 56. The electric coil 72 is electrically connected to a suitable electrical power source and control circuitry (not shown) in order to selectively energize the coil as hereinafter described. As also indicated in phantom in FIG. 1, an iron or like conductive core 74 is integrally molded within the second radiation-absorbing body 62, and extends adjacent to the periphery of the body. Normally, the coil spring 70 biases the beam-adjusting mechanism 58 upwardly into the position "2", as indicated in broken lines in FIG. 1. However, upon energization of the electric coil 72, an electric field surrounding the coil magnetically repels the core 74, and as indicated by the arrows in FIG. 1, drives the beam-adjusting apparatus 58 downwardly from position "2" into position "1" indicated in solid lines in FIG. 1.

As indicated schematically in FIG. 1, in position "1", the beam defines a diameter "A", and in position "2", the beam defines a diameter "B" less than diameter "A". In the illustrated embodiment, beam diameter A is approximately 9 inches at a source to image distance ("SID") "C" of approximately 40 inches, and beam diameter B is approximately 6 inches at an SID "C" of approximately 40 inches. However, as will be recognized by those skilled in the pertinent art based on the teachings herein, the size and shapes of the x-ray beams may be selectively controlled to virtually any desired size and/or shape by simply adjusting the sizes and shapes of the beam apertures in the beam limiting apparatus 26, and/or by adjusting the axial position of the beam-adjusting mechanism 58. In addition, the beam-adjusting mechanism may take any of numerous different forms which are currently, or later become known for performing the functions described herein. For example, the solenoid-type actuation of the beam adjusting mechanism 58 may take the form of any of numerous such solenoid-type mechanisms, such as double coils, double magnets, or other mechanical or electrical variations thereof. In addition, the position of the beam-adjusting mechanism 58 may be provided by a mechanical adjusting mechanism, such as a lead screw, or other type of threaded drive mechanism, a linkage mechanism, or any of numerous other mechanical or electromechanical drive mechanisms for performing the functions described herein. In addition, the beam-adjusting mechanism may be selectively positionable in any of a plurality of different positions with respect to the focal spot 26 in order to selectively collimate the beam to define any of a plurality of different beam sizes within a predetermined range of beam sizes. For example, in the embodiment of the present invention illustrated, the beam-adjusting mechanism 58 may be electrically controlled to selectively fix its position at any of a plurality of different positions between the positions 1 and 2 shown.

In the embodiment of the present invention illustrated, the x-ray entrance and exit apertures of the beam limiting apparatus 28 define the same peripheral shape as that of the focal spot 26. Typically, the focal spot 26 defines a rectangular peripheral shape, and therefore the x-ray entrance and exit apertures of the beam limiting apparatus are also rectangular. However, if desired, one or more of the beam limiting apertures may define a shape different than the shape of the focal spot in order to change the shape of the x-ray beam to a shape corresponding the shape of the aperture. For example, in image intensifier applications requiring a round field, a rectangular-shaped beam may be changed to a round beam by causing one or more of the beam limiting apertures to have the desired round or circular shape. In this exemplary case, the x-ray entrance aperture would define an approximately 1.2 mm square (or other sized square equaling the projected size of the focal spot) if placed directly at the edge of the projected effective focal spot perpendicular to the central ray. As the x-ray beam conduits 40 and 68 move away from the focal spot, the cross-sections of the conduits (and beam limiting apertures) would be changed to a more circular form with chords defining the respective four sides of the projected focal spot. The points of the chords would develop into a true circle at the second x-ray exit aperture 66 in order to generate a round field image. In each case, the x-ray entrance aperture 36 preferably defines a size approximately equal to the projected size of the focal spot 26 onto the base surface 34 of the radiation-absorbing body 32. As will be recognized by those skilled in the pertinent art based on the teachings herein, if the x-ray entrance aperture 36 is too large, then it will allow the passage of off-focus radiation therethrough. Accordingly, the dimensions of the x-ray entrance aperture are preferably approximately equal to the projected dimensions of the focal spot onto the base surface 34. If, on the other hand, the x-ray entrance aperture 36 is too small, it will undesirably reduce the intensity of the x-ray beam.

As also shown in FIG. 1, a mounting bracket 76 is seated over the cylindrical wall 54 and mounting flange 30 to fixedly secure the beam limiting apparatus 28 to the housing 12. As shown typically in FIG. 1, the housing 12 includes threaded apertures 78 for receiving mounting screws or other fasteners (not shown) for fixedly securing the mounting bracket 76 to the housing. If desired, the mounting bracket 76 may be fixedly secured to a gantry or other device for supporting the x-ray tube assembly. The mounting bracket 76 defines an x-ray aperture 79 in a top wall thereof overlying the other beam apertures for permitting the passage of the x-ray beam therethrough. As can be seen, the x-ray aperture 79 is larger than any of the underlying x-ray apertures in order to avoid interference with the x-ray beam.

As also shown in FIG. 1, the mounting boss 16 of the housing 12 defines a peripheral recess 80 for receiving the mounting flange 30 of the beam limiting apparatus 28. As can be seen, the outer diameter of the peripheral recess 80 is greater than the outer diameter of the mounting flange 30 to thereby allow the flange, and thus the radiation-absorbing body 32 to be moved laterally within the recess. The underside of the mounting bracket 76 similarly defines a first recess 82 for receiving therein the upper side of the mounting flange 30 and fixedly securing the mounting flange to the housing 12. As can be seen, the outer diameter of the first recess 82 is approximately equal to the outer diameter of the peripheral recess 80 of the mounting boss 16 to likewise allow the mounting flange 30 and radiation-absorbing body 32 to be moved laterally within the first recess of the mounting bracket. The mounting bracket 76 further defines a second recess 84 for receiving the cylindrical wall 54. Like the first recess 82, the second recess 84 defines a diameter greater than the outer diameter of the cylindrical wall 54 to thereby allow the cylindrical wall to move laterally within the recess. As also shown in FIG. 1, a plurality of alignment screws, shown typically at 86, are threadedly received through the side walls of the mounting bracket 76 and engage on their free ends the exterior sides of the cylindrical wall 54. Accordingly, the alignment screws 86 may be threadedly adjusted to, in turn, laterally adjust the position of the radiation-absorbing body 32 and thereby align the components with the "central ray" centerline (and with respect to the mounting boss holes 78).

As shown schematically in broken lines in FIG. 1, a flexible, substantially radiolucent material 88 extends across the predetermined gap 42 formed between the evacuated envelope 20 of the x-ray tube and the base surface 34 of the radiation-absorbing body 32 to prevent the passage of oil therethrough. In accordance with a preferred embodiment of the invention, the material 88 is a compressible silicone pad, which is substantially free of voids and foreign material, such as the silicone dielectric gel sold by Dow Corning under the designation Dow Corning Sylgard 527. Preferably, the silicone gel 88 is applied to the interface between the glass envelope 20 and the base surface 34 as shown, in order to completely fill the gap in the area underlying the x-ray entrance aperture 36, and thereby prevent the passage of oil through this area. The silicon gel 88 is preferably free of voids and any particulate or foreign matter in order to prevent any such non-homogeneous features from showing up as artifacts on the x-ray images. Thus, one advantage of this feature of the present invention, is that any air bubbles or other particulate matter that might be contained within the oil of the x-ray tube assembly is prevented from flowing through the x-ray beam, and therefore prevented from negatively affecting the x-ray images.

The beam limiting apparatus 28 preferably may further comprises cooling conduits connectable to a heat exchanger in order to cool the x-ray tube. As shown in FIG. 1, the beam limiting apparatus defines a first coolant inlet port 90 extending into the peripheral flange 30, a first coolant exit port 92 extending through another portion of the peripheral flange, and a first coolant conduit 94 coupled in fluid communication between the first inlet and outlet ports. As shown typically in FIG. 1, the first coolant conduit 94 preferably defines a serpentine shape within the base wall of the radiation-absorbing body 32 in order to maximize the surface area of the body in thermal communication with the coil. If desired, the coil 94 also could define a helical path within the approximately frusto-conical shaped side walls of the radiation-absorbing body 32 to further maximize the surface area of the body in thermal communication with the coils. The coils are preferably made of a thermally-conductive material and are molded integral with the radiation-absorbing body. Alternatively, the radiation-absorbing body 32 itself may define the first coolant conduit 94. The heat exchanger (not shown) may be any of numerous heat exchangers currently, or which later become available for performing the heat exchange functions described herein.

The mounting bracket 76 may further define a second coolant conduit 96, a second coolant inlet port 98 coupled in fluid communication with one end of the second coolant conduit, and a second coolant outlet port 100 coupled in fluid communication with the opposite end of the second coolant conduit for introducing a cooling fluid through the conduit. As can be seen, the second coolant conduit 96 extends along a helical path within the side wall of the mounting bracket 76 in order to cool the walls of the mounting bracket, and thereby facilitate in transferring heat away from the x-ray tube assembly. The second coolant conduit 96 may be coupled in fluid communication with the same heat exchanger as the first coolant conduit 94, or alternatively, may be connected to a different heat exchanger (not shown). As will be recognized by those skilled in the pertinent art based on the teachings herein, any of numerous different means for heat exchange may be employed for performing this function as described herein. For example, if desired, a thermoelectric cooler, such as a Peltier-effect device, may be thermally coupled to the mounting bracket and/or to the radiation-absorbing body in order to transfer heat away from these components in the manner described above.

The x-ray tube housing 12 may take any of numerous different shapes and configurations. For example, the housing 12 may be made in a conventional manner whereby the external shell of the housing is made of metal, such as aluminum, and the internal walls of the housing are lined with a radiation-absorbing material, such as lead. Preferably, however, the housing 12 is cast of the same or like filled epoxy resin as are the components of the beam limiting apparatus 28. In this configuration, an electrically conductive surface 102 is formed on the exterior side of the housing in order to ground the housing. This conductive surface 102 may be formed by a conductive paint or other conductive coating, or if desired, may be formed by a conductive skin or like thin layer attached to the outer surface of the filled epoxy casting.

Figure 2:
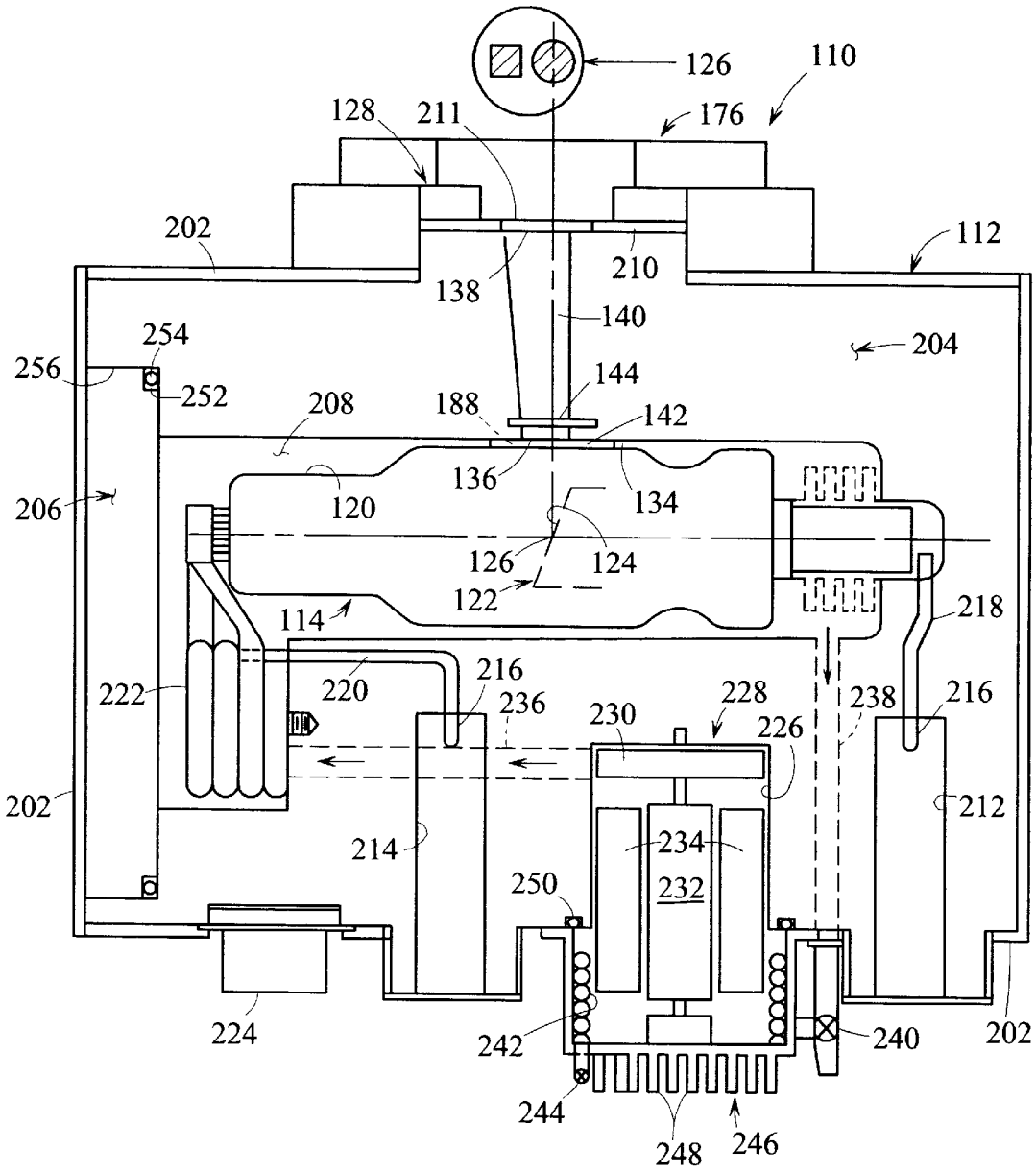
FIG. 2 is a partial schematic, cross-sectional view of a second embodiment of the beam limiting apparatus integrally molded with an x-ray tube housing in a filled-epoxy resin material in accordance with the invention.

Turning to FIG. 2, another embodiment of an x-ray tube assembly of the invention is indicated generally by the reference numeral 110. The x-ray tube assembly 10 is substantially similar to the x-ray tube assembly 10 described above, and therefore like reference numerals preceded by the numerals "1" or "2" are used to indicate like elements. One of the primary differences of the x-ray tube assembly 110 is that the beam limiting apparatus 128 is molded integral with the x-ray tube housing 112, and does not include a beam-adjusting mechanism. As can be seen, the housing 112 is molded with a filled polymeric, substantially non-conductive, radiopaque material. Preferably, the filled polymeric material is the same filled epoxy resin material as described above in connection with the previous embodiment; however, as will be recognized by those skilled in the pertinent art based on the teachings herein, any of numerous other types of filled polymeric materials which currently, or later become known for performing the functions of the housing described herein may be equally employed.

The housing 112 includes a first casting 204 and a second casting 206, and each casting has formed on the exterior sides thereof the conductive surface or shell 202. As indicated above, the conductive surface 202 may be applied as a conductive paint or like coating, or may be applied as a thin metal shell fixedly secured to the castings with nylon or like non-conductive screws or other fasteners (not shown). As shown in FIG. 2, the first casting 204 defines a hermetically-sealed cavity 208 for receiving the x-ray tube 114. The first casting 204 further defines the beam limiting apparatus 128 integrally molded therein, including the base surface 134 spaced in close proximity to the evacuated envelope 120, the x-ray entrance aperture 136, the x-ray transmissive window 144 molded into the beam conduit 140, and the x-ray exit aperture 138. If desired, a beam limiting plate 210 may be mounted over the x-ray exit aperture 138 to further perform the beam limiting function. The beam limiting plate 210 may be a conventional beam limiting plate formed of a radiopaque material, and defining a beam limiting aperture 211 for further controlling the size and shape of the image-forming beam. In addition, the beam limiting plate 210 may be laterally adjustable in a conventional manner, and/or the position of the x-ray tube 114 within the housing may be axially adjustable in a conventional manner in order to align the x-ray apertures of the beam limiting apparatus with the central ray. The mounting bracket 176 is fixedly secured to the housing in the same manner as the mounting bracket 76 described above.

As also shown in FIG. 2, the first casting 204 further defines an anode plug cavity 212, and a cathode plug cavity 214, each having respective terminal pins 216 integrally molded into the base of the cavity for connection to a male plug of a type known to those skilled in the pertinent art (not shown). An anode conduit 218 is formed between the pin(s) 216 of the anode plug cavity 212 and the anode end of the hermetically-sealed cavity 208 for electrically connecting the pins to the anode of the x-ray tube. Similarly, a cathode conduit 220 is formed between the pin(s) 216 of the cathode plug cavity 214 and the cathode end of the hermetically-sealed cavity 208 for connecting the pins to a filament transformer 222, which, in turn, is connected to the cathode of the x-ray tube 114. A suitable interface plug 224 is integrally molded into the side wall of the housing 112 adjacent to the filament transformer for providing an electrical connection thereto. An oil pump cavity 226 is also formed in the side wall of the first casting 204 for receiving an oil pump assembly 228. The oil pump assembly 228 includes a vane or like impeller 230 rotatably driven by an electric motor including a rotor 232 and stator 234. An oil inlet conduit 236 is formed in fluid communication between the oil pump cavity 226 and the cathode end of the x-ray tube cavity 208, and an oil outlet conduit 238 is formed in fluid communication between the anode end of the x-ray tube cavity 208 and the oil pump cavity 226. A suitable valve 240 is connected to the oil outlet conduit 238 for filling the interior of the housing 112 with oil. An oil volume compensation tube 242 lines an interior surface of the oil pump cavity 226 in order to compensate for variations in oil volume due, for example, to thermal expansion and contraction of the oil during operation. The oil volume compensation tube 242 is connected in fluid communication with an air vent 244 in order to fill the tube with air. A heat sink 246 is mounted over the oil pump cavity 226 to enclose the oil pump assembly 228 within the cavity, and includes a plurality of cooling fins 248 on an exterior surface thereof for facilitating heat exchange between the oil and the ambient atmosphere. The heat sink 246 is hermetically sealed to the housing by an o-ring or like sealing member 250, and is fixedly secured to the housing with suitable fasteners (not shown). If necessary, threaded inserts may be molded into the casting 204 at suitable locations for receiving the fasteners for attaching the heat sink and any other components of the x-ray tube assembly.

The second casting 206 forms a cover for enclosing the x-ray tube 114 within the housing. As shown in FIG. 2, the second casting defines a peripheral groove 252 for receiving an o-ring or like sealing member 254, and fasteners (not shown) are employed to attach and thereby hermetically seal the cover 206 to the housing. As also shown, the first casting 204 defines a recess 256 for receiving the cover, and there is a substantial overlap of the cover and the base surface of the recess to prevent the emission of any radiation through any interfaces of the first and second castings.

One advantage of the x-ray tube assembly 110 is that the entire housing may be made of a filled polymeric material, such as the filled epoxy resin described above, and therefore there is no need to line the housing with lead or other radiation-absorbing materials. Accordingly, substantial cost benefits can be achieved by employing the housing of the present invention.

Figure 4:
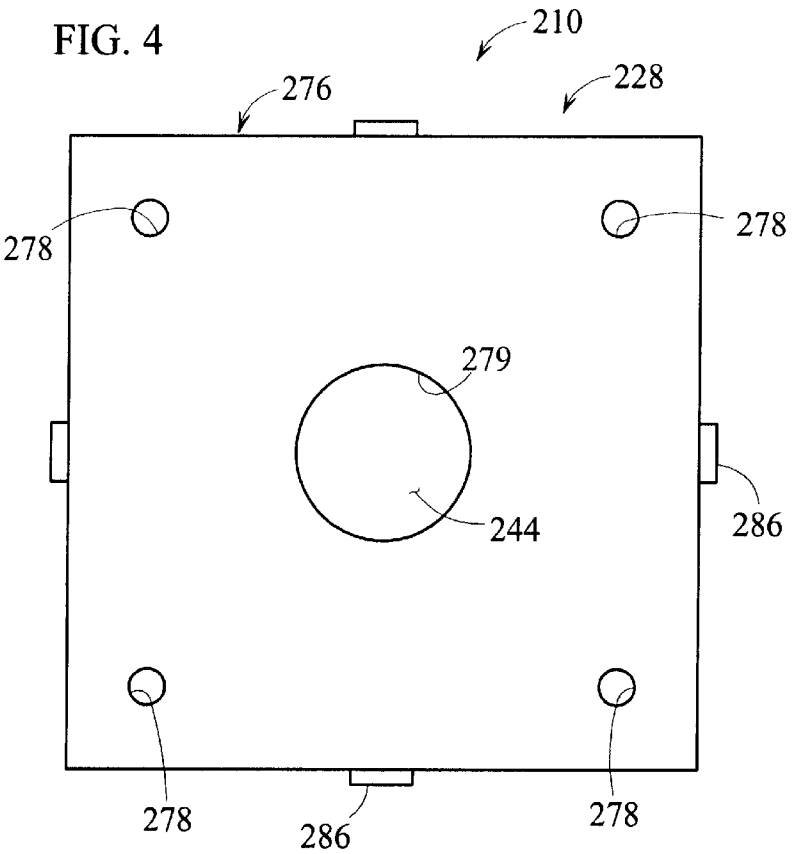
FIG. 4 is a top plan view of the beam limiting apparatus of FIG. 3.
Figure 3:
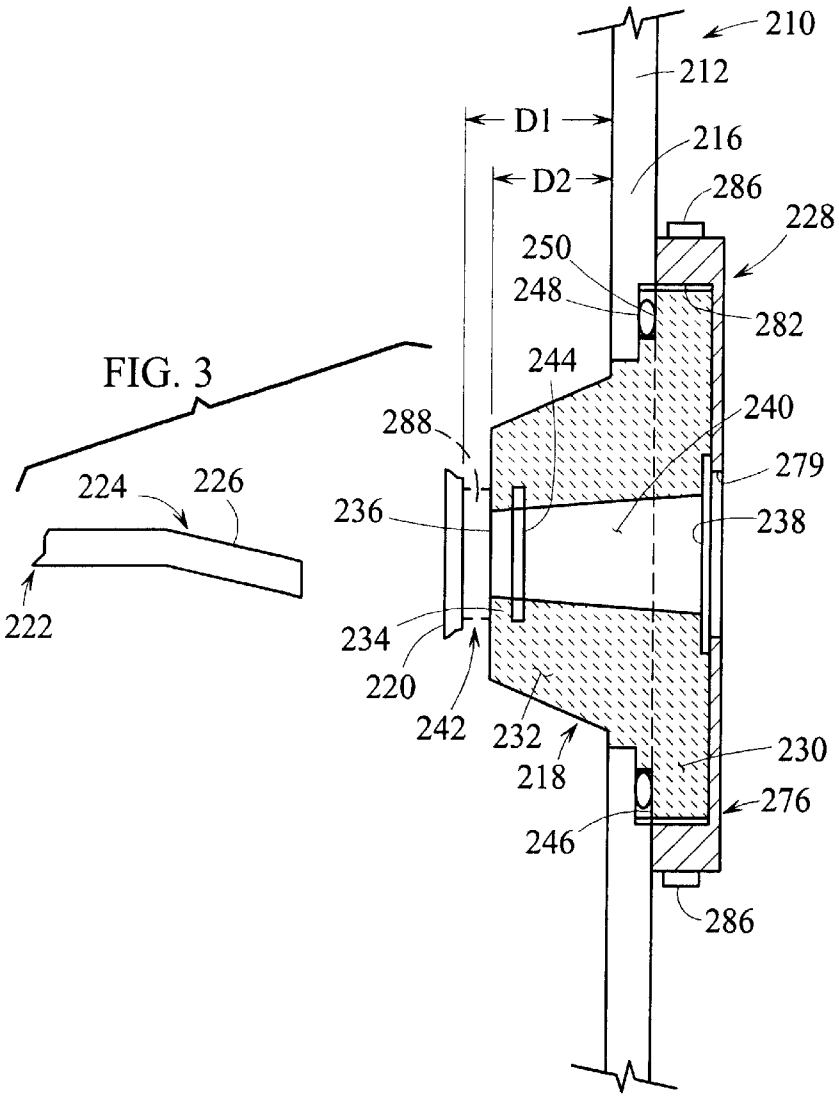
FIG. 3 is a cross-sectional view of another embodiment of a beam limiting apparatus of the invention.

Turning to FIGS. 3 and 4, another x-ray tube assembly including a beam limiting apparatus embodying the present invention is indicated generally by the reference numeral 210. The x-ray tube assembly 210 is similar to the x-ray tube assemblies described above in connection with the previous embodiments, and therefore like reference numerals preceded by the numerals "2" and "3" are used to indicate like elements. The primary difference of the beam limiting apparatus 228 of FIGS. 3 and 4 is that it is provided in the form of a cone-shaped part that may be mounted within a conventional x-ray tube housing port 218. In addition, like the beam limiting apparatus 128 described above in connection with FIG. 2, the beam limiting apparatus 228 does not include a beam adjusting mechanism for adjusting the size of the x-ray beam.

As shown in FIG. 3, the peripheral flange 230 and radiation-absorbing body 232 of the beam limiting apparatus 228 are integrally molded with a filled polymeric material which is electrically non-conductive and radiopaque. Preferably, the filled polymeric material is the same as the filled epoxy resin described above in connection with the previous embodiments; however, as will be recognized by those skilled in the pertinent art based on the teachings herein, any of numerous other materials which now, or later become known may be employed for performing the functions described herein.

The housing 212 defines an x-ray port 218, and a annular recess 248 extending about the periphery of the x-ray port for receiving an o-ring or like sealing member 250 to hermetically seal the beam limiting apparatus to the housing. The mounting bracket 276 defines on its underside the first recess 282 for receiving therein the peripheral flange 230. The flange 230 is movable laterally within the recess 282 to align the position of the x-ray apertures with the central ray. The adjustment screws 286 are provided to laterally adjust and fix the position of the beam limiting apparatus within x-ray port 218. As shown in FIG. 4, the mounting bracket 276 includes a plurality of apertures overlying the threaded apertures 278 in the mounting boss 216 of the housing 212 to threadedly attach the mounting bracket to the boss with fasteners (not shown) and, in turn, fixedly secure and hermetically seal the beam limiting apparatus to the housing.

As in the embodiments described above, the x-ray transmissive window 244 may be made of any desired material, and is preferably molded integral with the radiation-absorbing body 232 and forms a hermetic seal between the x-ray transmissive window and radiation-absorbing body. If desired, a layer of silicone gel or like material 288 may be interposed between the base surface 234 and the evacuated envelope 220 in the same manner as described above in connection with the previous embodiments in order to prevent the passage of oil and/or particulates therethrough.

Figure 6:
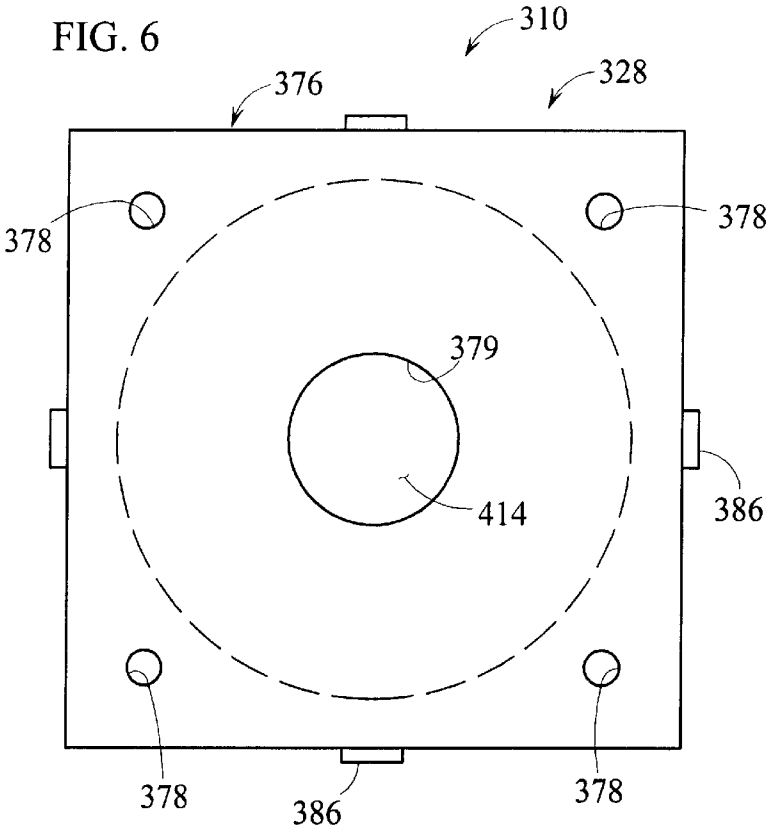
FIG. 6 is a top plan view of the beam limiting apparatus of FIG. 5.
Figure 5:
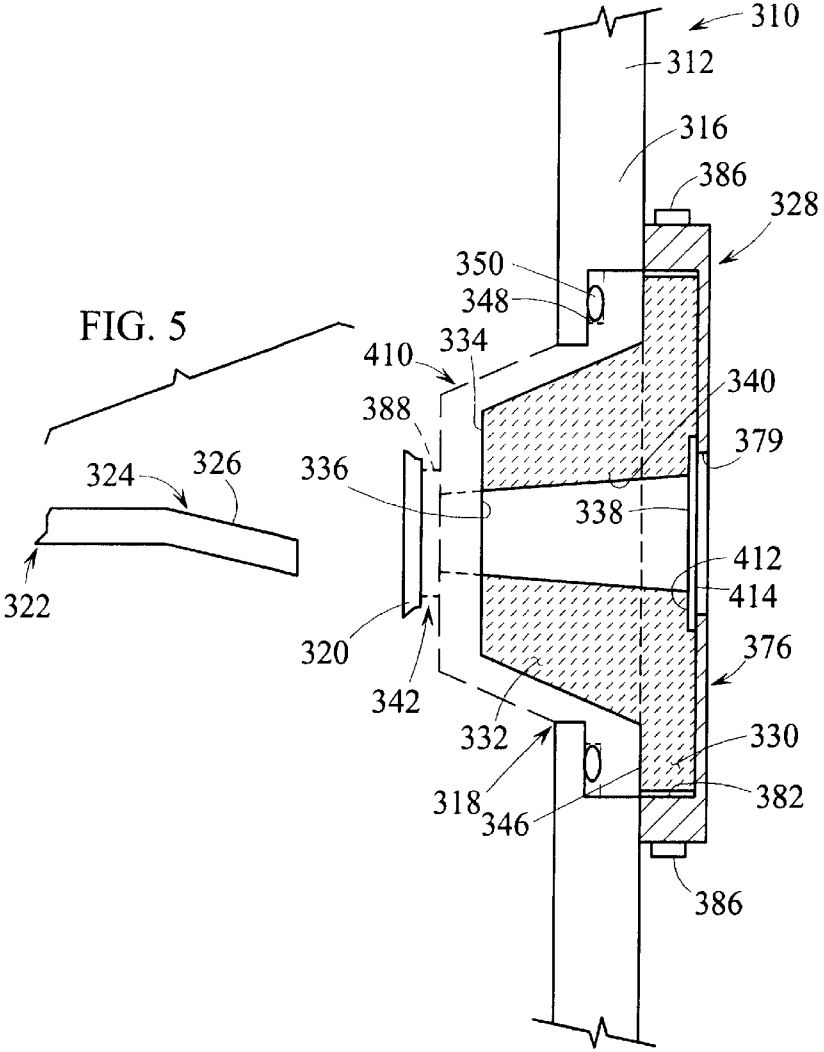
FIG. 5 is a cross-sectional view of another embodiment of a beam limiting apparatus of the invention mountable within a typical cup-shaped, polymeric x-ray window.

Turning to FIGS. 5 and 6, another x-ray tube assembly including a beam limiting apparatus embodying the present invention is indicated generally by the reference numeral 310. The x-ray tube assembly 310 is similar to the x-ray tube assembly 210 described above in connection with FIGS. 3 and 4, and therefore like reference numerals preceded by the numerals "3" and "4" instead of the numerals "2" and "3" are used to indicate like elements. The primary difference of the beam limiting apparatus 328 of FIGS. 5 and 6 is that it may be mounted within, or on the exterior side of a conventional cup-shaped x-ray window, such as a conventional polycarbonate window.

As indicated in broken lines in FIG. 5, a typical cup-shaped polycarbonate or other polymeric window 410 may be mounted within the x-ray port 318 and extend downwardly into the housing toward the focal spot 326 of the x-ray tube. Accordingly, a predetermined gap 342 may be formed between the polymeric window and the exterior surface of the evacuated envelope 320. In this case, the radiation-absorbing body 332 is seated within the polymeric window 410 with the base surface 334 seated against the base wall of the window 410. Since the polymeric window 410 is hermetically sealed to the x-ray tube housing 312 in a typical manner, such as with the o-ring groove 348 and o-ring 350, the beam limiting apparatus 328 need not include the x-ray transmissive window, but rather may simply define an open passageway between the x-ray entrance aperture 336 and x-ray exit aperture 338. However, as shown in FIG. 5, the radiation-absorbing body 332 preferably defines an annular recess 412 extending about the periphery of the x-ray exit aperture 338 in order to receive a filtration member 414. The filtration member 414 may be made of aluminum or other suitable filtration material, and is provided in a predetermined thickness in order to achieve the requisite level of filtration of the x-ray beam. The filtration member 414 is seated within the recess 412, and retained within the recess by the overlying mounting bracket 376. If desired, a plurality of such filtration members may be provided, each defining a respective thickness and/or level of x-ray filtration, in order to allow an operator to selectively install the different filtration members to achieve different predetermined levels of beam filtration.

The mounting bracket 376 defines on its underside the first recess 382 for receiving therein the peripheral flange 330. The flange 330 is movable laterally within the recess 382 to align the position of the x-ray apertures with the central ray. The adjustment screws 386 are provided to laterally adjust and fix the position of the beam limiting apparatus within the cup-shaped window 410.

As will be recognized by those skilled in the pertinent art based on the teachings herein, numerous changes and modifications may be made to the above-described and other embodiments of the present invention without departing from the scope of the invention as defined in the appended claims. As one example, the filled epoxy resin x-ray housing of the invention can be made of any number of castings that may be connected together in the same manner, or in a manner similar to the hermetically-sealed connection of the two castings described above. In addition, if desired, the embodiments of FIGS. 2–6 could include cooling coils or conduits, or other cooling devices, as disclosed above in connection with the embodiment of FIG. 1. Similarly, the x-ray tube housing of FIG. 2 could be modified in any of numerous ways, including the provision of a conventional x-ray port (as shown, for example, in the other embodiments), and a beam limiting apparatus with beam adjusting or collimating mechanism of the type shown in FIG. 1. Accordingly, this detailed description of the preferred embodiments is to be taken in an illustrative as opposed to a limiting sense.

What is claimed is:

1. A beam limiting apparatus for reducing the emission of off-focus radiation from an x-ray tube assembly, wherein the x-ray tube assembly comprises a housing including an x-ray port for the passage of x-rays therethrough, a first mounting surface formed adjacent to the x-ray port, an x-ray tube mounted within the housing and including an evacuated envelope, an anode mounted within the envelope, and a cathode spaced relative to the anode within the envelope, wherein the anode defines a target surface, the cathode projects onto the target surface a focal spot defining a first size and shape, the x-ray port is spaced relative to the focal spot for receiving x-radiation emitted therefrom, and the x-ray port and envelope define a first predetermined depth therebetween, the beam limiting apparatus comprising:

a peripheral flange defining a second mounting surface locatable over the first mounting surface of the housing for fixedly securing the beam limiting apparatus to the housing;

a radiation-absorbing body projecting outwardly from the peripheral flange and receivable through the x-ray port, the radiation-absorbing body defining a base surface, an x-ray entrance aperture formed through the base surface, an x-ray exit aperture spaced relative to the x-ray entrance aperture, and an x-ray transmissive beam conduit formed between the entrance and exit apertures, wherein the base surface extends into the housing a second depth less than the first depth with the base surface spaced closely adjacent to the evacuated envelope of the x-ray tube and defining a predetermined gap therebetween, the radiation-absorbing body is formed of a substantially electrically nonconductive, filled polymeric material, the x-ray entrance aperture defines a second size and shape, the x-ray exit aperture defines a third size and shape, and the second and third sizes and shapes are selected to define an x-ray beam of predetermined corresponding size and shape.

2. A beam limiting apparatus as defined in claim 1, further comprising an x-ray transmissive window extending across the beam conduit.

3. A beam limiting apparatus as defined in claim 2, wherein the x-ray transmissive window is molded integral with the radiation-absorbing body.

4. A beam limiting apparatus as defined in claim 1, wherein the x-ray transmissive window is made of an epoxy resin.

5. A beam limiting apparatus as defined in claim 4, wherein the x-ray transmissive window is optically transparent.

6. A beam limiting apparatus as defined in claim 4, wherein the x-ray transmissive window is metallic.

7. A beam limiting apparatus as defined in claim 1, wherein the x-ray port defines a recess for receiving the peripheral flange, the recess is defined by a first dimension, the peripheral flange is defined by a second dimension less than the first dimension to allow the flange to move within the recess, and further comprising at least one adjusting member coupled between the x-ray port and the peripheral flanges, and movable relative to at least one of the peripheral flange and x-ray port for adjusting the position of the peripheral flange relative to the x-ray port and, in turn, adjusting the position of the entrance aperture relative to the focal spot.

8. A beam limiting apparatus as defined in claim 1, wherein the entrance aperture defines approximately the same shape as the focal spot.

9. A beam limiting apparatus as defined in claim 8, wherein the second size and shape of the entrance aperture is approximately equal to the projection thereon of the first size and shape of the focal spot.

10. A beam limiting apparatus as defined in claim 8, wherein the exit aperture defines approximately the same shape as the entrance aperture and focal spot.

11. A beam limiting apparatus as defined in claim 1, further comprising a flexible, substantially radiolucent material extending across the predetermined gap between the evacuated envelope and base surface of the body, and substantially preventing the passage of oil therethrough and the accumulation of any foreign materials therein.

12. A beam limiting apparatus as defined in claim 1, wherein the predetermined gap between the evacuated envelope and base surface defines a width sufficient to allow differential thermal expansion between the x-ray tube and beam limiting device without contacting each other during operation of the x-ray tube.

13. A beam limiting apparatus as defined in claim 12, wherein the width of the predetermined gap is within the range of approximately 0.040 to approximately 0.080 inches.

14. A beam limiting apparatus as defined in claim 1, in combination with an x-ray tube housing comprising:

a plurality of walls defining interior and exterior sides, wherein a plurality of the interior sides of the walls define a hermetically-sealed cavity for receiving and enclosing an x-ray tube therein, at least the interior side of each of the plurality of walls of the housing defining the hermetically-sealed cavity is formed of a radiopaque, substantially electrically non-conductive, filled polymeric material, and wherein the plurality of walls defining the hermetically-sealed cavity thereby define a radiopaque enclosure for receiving the x-ray tube, and the interior sides of the plurality of walls defining the hermetically-sealed cavity are spaced relative to an x-ray tube received therein to allow the passage of oil between the x-ray tube and walls;

an x-ray port formed through at least one of the housing walls and defining a radiolucent aperture extending into the hermetically-sealed, radiopaque enclosure for allowing the transmission of x-rays therethrough; and an electrically conductive surface located on the exterior sides of a plurality of the housing walls.

15. A beam limiting apparatus and x-ray tube housing as defined in claim 14, wherein the housing includes first and second castings of said filled polymeric material, the first casting defines the x-ray port, the beam limiting device formed within the x-ray port, the hermetically-sealed cavity, and at least one aperture extending into the hermetically-sealed cavity for receiving an x-ray tube therethrough, and the second casting defines a cover attachable to the first casting for hermetically sealing an x-ray tube therein.

16. A beam limiting apparatus and x-ray tube housing as defined in claim 14, wherein the electrically conductive surface is formed by a conductive coating applied to the exterior surfaces of a plurality of the filled polymeric walls of the housing.

17. A beam limiting apparatus as defined in claim 15, wherein the first casting further defines an anode plug cavity, a cathode plug cavity, and at least one oil cavity coupled in fluid communication with the hermetically-sealed cavity for receiving at least one of an oil pump and a reservoir of oil.

18. A beam limiting apparatus as defined in claim 1, further comprising a beam-adjusting mechanism for adjusting at least one of the size and shape of the image forming x-ray beam, and including a substantially radiopaque wall and a beam limiting aperture formed through the radiopaque wall, wherein the beam limiting aperture overlies and is in registration with the x-ray entrance aperture, and is movable radially relative to the x-ray entrance aperture and focal spot to, in turn, adjust at least one of the size and shape of the image forming beam.

19. A beam limiting apparatus as defined in claim 18, wherein the radiopaque wall of the beam adjusting mechanism is made of a substantially electrically non-conductive, filled polymeric material.

20. A beam limiting apparatus as defined in claim 18, further comprising means for moving the beam limiting aperture of the beam adjusting mechanism between at least first and second positions relative to the x-ray entrance aperture and focal spot for adjusting the size of the image forming beam.

* * * * *